US006296054B1

(12) United States Patent
Kunz et al.

(10) Patent No.: US 6,296,054 B1
(45) Date of Patent: Oct. 2, 2001

(54) STEEP PITCH HELIX PACKER

(76) Inventors: Dale I. Kunz, 700 840-6th Avenue S.W., Calgary, Alberta (CA), T2P 3E5; Maurice W. Slack, 1831 - 104A Street, Edmonton, Alberta (CA), T6J 5C1; Trent M. V. Kaiser, 10912 - 16 Avenue, Edmonton, Alberta (CA), T6J 5G6

( * ) Notice: Subject to any disclaimer, the term of this patent is extended or adjusted under 35 U.S.C. 154(b) by 0 days.

(21) Appl. No.: 09/522,680

(22) Filed: Mar. 10, 2000

Related U.S. Application Data

(60) Provisional application No. 60/124,149, filed on Mar. 12, 1999.

(51) Int. Cl.[7] ..... E21B 33/127
(52) U.S. Cl. ..... 166/187; 166/195
(58) Field of Search ..... 166/187, 192, 166/195, 196, 118, 132, 141

(56) References Cited

U.S. PATENT DOCUMENTS 2,872,230 * 2/1959 Desbrandes ..... 166/187
4,357,992 * 11/1982 Sweeney ..... 166/250
4,614,346 * 9/1986 Ito ..... 166/187 X
4,892,144 * 1/1990 Coone ..... 166/122
5,327,963 * 7/1994 Vance, Sr. et al. ..... 166/187
5,579,839 * 12/1996 Culpepper ..... 166/118
5,702,109 * 12/1997 Mahin et al. ..... 277/34
6,044,906 * 4/2000 Saltel ..... 166/187

FOREIGN PATENT DOCUMENTS

2232671 * 1/1975 (FR) .
2262553 * 6/1993 (GB) .

* cited by examiner

*Primary Examiner*—Frank S. Tsay
(74) *Attorney, Agent, or Firm*—Sheridan Ross P.C.

(57) ABSTRACT

A seal element is provided which comprises inner and outer, concentric, radially spaced apart, tubular helical cages. Each cage is formed by a plurality of helically parallel steel coils joined at their upper and lower ends by integral sleeves. A nitrite bladder is positioned between the cages. The seal element can be expanded by supporting its base and applying compressive load.

4 Claims, 2 Drawing Sheets

STEEP PITCH HELIX PACKER

The present application claims the benefits under 35 U.S.C.§119(e) of U.S. Provisional Application Ser. No. 60/124,149, filed Mar. 12, 1999 and entitled "STEEP PITCH HELIX PACKER".

FIELD OF THE INVENTION

The present invention relates to an expandable composite seal assembly which finds application in a packer for use in wells.

BACKGROUND OF THE INVENTION

The present invention was conceived as a means to specifically provide an adequate level of hydraulic isolation between zones in a non-cased horizontal oil well bore. As such, a cost effective method was being sought to install two or more packers in a tubing 'string' as a means to shut off zones of high water inflow. However, the device configurations developed to meet the requirements of this particular application may be applied more generally to include many other applications serviced by packers or bridge plugs and indeed by other annular sealing devices such as blowout preventers.

However the invention will be described in the context of downhole packers and bridge plugs.

Within the context of petroleum drilling and completion systems, existing methods to provide hydraulic isolation (sealing) between portions of a well bore or well bore annulus, whether cased or open, may be broadly divided into two types of seal element: 1) bulk expansion (compression set) and, 2) inflatable. Devices employing either of these seal element methods are commonly referred to as either bridge plugs or packers, depending respectively on whether full cross sectional or annular closure is ultimately required. Since closure of an annular space with respect to the device is always required, the term Packer is employed herein to refer generally to all such devices.

In either case the packer must provide sufficient annular clearance to first permit insertion into the well bore to the desired depth or location and a means to subsequently close this annular clearance to effect an adequate degree of sealing against a pressure differential. It is often also desirable to retract or remove these devices without milling or machining.

Packers relying on bulk expansion of the seal element typically employ largely incompressible but highly deformable materials, such as elastomers, as the sealing element or element 'stack' where the element is cylindrically or toroidally shaped and is carried on an inner mandrel. U.S. Pat. Nos. 5,819,846 and 4,573,537 are two examples of such devices using an elastomer and ductile metal (non-elastomeric) respectively for the deformable seal element material. The seal is formed by imposing axial compressive displacement of the element, causing the material to incompressibly expand radially to close off the annular region, and after contact with the confining borehole or casing is achieved, to apply sufficient pre-stress to promote sealing. The amount of annular expansion and sealing achievable with elastomers is dependent on several variables but is generally limited by the extrusion gap allowed by the running clearance. The size of annular gap sealable with ductile metals is similarly limited, although for slightly different reasons, and since the deformation is largely irreversible presents a further impediment to retrieval. For either elastomer or ductile metals practically achievable axial seal lengths are short, in the order of a few inches, and therefore sealing on rough surfaces is not readily achievable. This limitation to sealing small clearances with relatively short seal lengths and limited conformability, even for elastomers, tends to preclude using this method for sealing against most open bore hole surfaces. Furthermore, this style of device must usually also provide a means to react axial load, e.g., slips, separate from the sealing element. Such axial loads arise from pressure differentials acting on the sealed area plus loads transmitted by attached or contacting members. The axial loads typically exceed either the frictional or strength capacity of the seal material. This is especially true as the sealed area (hole diameter) is increased. Managing the setting and possible release of the associated anchoring systems adds considerable complexity to these devices with associated cost and reliability implications. Similarly, the degree of complexity, cost and uncertainty is further increased where the application requires axial load reversal as arises when the pressure differential may be in either direction. Both the sealing and mechanical retaining hardware tends to require significant annular space, therefore the maximum internal bore diameter is significantly smaller than the setting diameter.

Devices relying on inflation of the 'membrane' seal element employ a generally cylindrical sealing element (visualize hose), capable of expanding radially outward when pressured from the inside with a fluid. The sealing element is carried on a mandrel with end closure means, to contain pressure, and accommodate whatever axial displacement is required during inflation. The sealing element in these devices is typically of composite construction where an elastomer is reinforced by stiffer materials such as fibre strands, wire, cable or metal strips (also commonly referred to as slats). U.S. Pat. No. 4,923,007 is one example of such a device employing axially aligned overlapping metal strips. Pressure containment by these elements relies largely on membrane action. The sealing element may be considerably longer and more conformable than in bulk expansion devices. Inflation packers are therefore most commonly employed for sealing against the open bore hole wall. The inflation material may be either a gas, liquid or 'setting' liquid such as cement slurry. Where the inflation material stays fluid, pressure must be continuously maintained to effect a seal. If the device develops a leak after inflating, the sealing function will be lost. To circumvent this weakness a setting liquid may be used, e.g., cement; therefore pressure need only be maintained until sufficient strength is reached. However the device then becomes much more difficult to remove since it cannot be retracted through reverse flow of the inflation fluid. Typically it can only be removed by machining or milling. Similar to the bulk expansion method, the membrane strength of these devices significantly limits the ability to react axial load and the annular space requirements of membrane end seals and mandrel can be quite large. Therefore inflatable packer elements tend to suffer from the same limited axial load and through bore capacities as bulk expansion packer elements.

SUMMARY OF THE INVENTION

The present invention is founded on the geometric and structural properties of one or more closely spaced helical coils, preferably joined at their ends, to form a helical cage. The helical cage may be visualized as several identical loosely wound coil springs, formed from rectangular section strips coaxially 'screwed' together, where the individual coil ends are preferably joined at both ends to sleeves, preferably of diameter equal to the spring diameter. The coils preferably have a steep pitch (say with helix angles of about 45°), leaving little gap between adjacently strip bodies. To provide sealing, the gaps or slits between adjacent coils are bridged by a suitable material, typically an elastomer, thereby forming a composite wall system usable as a packer element. In addition to enabling fluid tight bridging, an elastomer layer or sleeve may be employed on either or both sides of the cage to further promote contact sealing. This composite wall is not unlike that formed in reinforced hose construction, where a metal spring made of rigid material is imbedded in the hose wall of an otherwise flexible material to provide structural support resisting collapse and burst pressure loads.

In the present case the helical cage makes the 'hose' capable of being expanded as the axial length is reduced, i.e., the helical cage enables a 'setting' response characteristic of bulk expansion packer elements. It should be clear this implies that the inverse retraction response occurs with axial extension, i.e., an inverse relation exists between axial and radial deformation. The axial length change and associated inverse diameter change may be accomplished by release of stored elastic energy (coils acting as springs), application of differential pressure or application of axial load where any of these activation mechanisms may be used either separately or in combination. In addition, the helical cage is capable of bearing significant compressive load when confined inside a cylindrical bore. Combined with the usual pressure containment ability of a hose, these properties together make this system very suitable for use in a variety of packer applications.

It should also be mentioned that expansion of the helical cage can also be accomplished by rotation, opposite to the direction of coil winding. This may in fact be combined with axial movement, however for simplicity of presentation, and consistent with the preferred embodiment, only non-rotational axial setting movement is used hereinbelow to explain the principles of the method. It should then be clear to one skilled in the art, how setting rotation may be used to further advance the utility of the method in certain applications.

In a preferred embodiment, the individual coils exist as strips separated by gaps or slits in a rigid cylinder (tube) where the slits occur over an interval of the total cylinder length such that the coil ends are left attached to an uncut portion of the tube, effectively leaving cylindrical sleeves at both ends. The helix angle and number of circumferentially distributed strips may be varied, along with other properties such as strip thickness, to obtain helical cage configurations having geometry and structural characteristics desirable for construction of packer sealing elements. Some of the more significant of these desirable properties are large expansion capacity, small extrusion gaps between or around reinforcing strips, high mechanically retained seal contact force and high tension and compression load capacity. Expansion without significant rotation is also a desirable design characteristic as this tends to simplify several design factors.

For purposes of this description, the phrase "structural helical coil" indicates a coil formed of material having some elasticity, so that the coil may be deformed under the application of compressive load into contact with a confining, adjacent, substantially cylindrical wall (such as a borehole wall), said coil being operative to transmit compressive load along the helix without local buckling.

For purposes of this description, the phrase "elastomeric" indicates a solid coil formed of material having some elasticity, so that the coil may be deformed under the application of compressive load into contact with a confining, adjacent, substantially cylindrical wall (such as a borehole wall), said coil being operative to transmit compressive load along the helix without local buckling.

For purposes of this description, the phrase "elastomeric" indicates a solid resilient material (such as nitrile) whose stiffness is substantially less than the structural material of the coil (typically steel).

Broadly stated then, in one embodiment the invention is directed to a radially expandable seal element for bridging an annular clearance, comprising: a cylindrical cage having a side wall formed by a plurality of structural, coaxial, helically parallel coils having side edges; and elastomeric means for sealing the side edges of the coils to provide pressure containment across the cage side wall. Preferably the ends of the coils are connected to end sleeves.

In another embodiment, the invention is directed to the radially expandable seal element as just described but comprising inner and outer cylindrical cages, the coils of one cage preferably having a helix screw direction opposed to the helix screw direction of the other cage, with elastomeric means for sealing the side edges of the coils as aforesaid.

The present invention therefore introduces a novel type of radially expandable seal element useful in a packer downhole. This architecture may be described as a membrane seal element packer, where the element is capable of being expanded by and reacting axial load thus enabling a variety of differentiating performance characteristics and design alternatives. These include the ability to expand the device through application of internal pressure and mechanically maintain the expanded state after fluid pressure is removed. Alternately the device may be compression set and mechanically retained. It tends to be self anchoring since the element is capable of reacting significant axial loads. It also accommodates retrieval, is amenable to either open or cased hole applications and has a symmetric response to direction of axial loading. In the preferred embodiment, the simplicity of architecture lends itself to reduced manufacturing coast and small annular space requirements, both significant advantages over the existing alternatives.

Helical Cage Geometric Design Properties

Placing the helical cage in this design context, first consider how the helix angle, defined here as the angle formed between the cylinder axis and a line tangent to a coil, affects two significant geometry relationships of a helical cage: 1) diameter change (diametrial strain) as a function of axial length change (axial strain) and, 2) coil spacing (strain normal to coil direction) also as a function of axial length change. In the limits the helix angle approaches either 90°, as occurs in typical coil springs, or zero degrees as occurs in inflatable packers employing overlapping strips as previously referenced in U.S. Pat. No. 4,923,007.

In the first case, helix angle approaching 90°, diameter is insensitive to change in axial length (axial strain) however change in coil spacing is almost directly proportional to change in axial length per unit pitch. High helix angles are thus only suitable for applications requiring little expansion capacity. In addition, this configuration requires that the design accommodate a large range of gap variation. In the second case, helix angel near zero, expansion initially occurs with negligible axial compression and the change in coil spacing is directly proportional to circumferential expansion per coil. Thus while low helix angles provide the greatest expansion capability, they suffer from the same limitation of large gap variation as high helix angle cages. Mitigating this effect is in large part the motive behind methods such as the interlocking strips, described in U.S. Pat. No. 4,923,007, which correspond to helix angles near zero.

However, if the helix angle falls between these two 'conventional' limits, say near 45°, the geometric behavior has characteristics which are peculiarly well suited to packer applications. In this third case the diametral strain is about equal to axial compressive strain but coil spacing is comparatively insensitive to axial strain. This implies that the helical cage may be considerably expanded with only slight changes in coil spacing, greatly facilitating elastomer membrane containment.

Helical Cage Structural Design Properties

Next consider the structural characteristics of a helical cage when expanded inside a cylindrical confining surface. To promote sealing, the packer must be kept in its expanded state. In general, this implies adequate contact stress must be maintained between the packer element and the confining wall. In some applications low enough seepage rates may be achievable without significant contact stress as such, provided a sufficiently small gap is maintained between the packer element and confining wall for a given packer length. Nonetheless, it is almost always desirable to maintain some level of contact stress even to support such seepage control applications.

In many applications a further structural need arises where the packer must react an axial load into the confining wall. It is therefore desirable to have elements that can react significant axial loads, in addition to sealing, as this can greatly simplify design complexity. In such cases, maintaining contact stress is imperative since the reaction mechanism depends on developing sufficient friction resistance over the interfacial region.

Depending on the helix angle, contact stress can be maintained either mechanically, hydraulically or both. Referring to the three helix angle cases already introduced, a high angle helix is only amenable to compressive activation, a low angle to pressure activation but at intermediate angles both may be used although pressure activation is further limited to cases where the helix angle is such that the pressure end load induced axial load does not cause diameter reduction.

Maintaining contact stress by pressure activation of a seal element constructed using a helical cage is similar to the action in strip or cable reinforced or retained inflatable packers. In these devices, the element is mounted on a mandrel where at least one end sleeve forms a sliding seal. Application of differential pressure into the confined space between the interior surface of the expansion element and the mandrel causes the element to expand and foreshorten. As expansion causes the element to contact the confining surface, increased inflation tends to increase the contact stress over the contacting length interval so that the packer only seals if this pressure is maintained. As will be apparent to one skilled in the art, for angles near zero, the helical cage behavior approaches that of a conventional strip reinforced inflatable packer where the contact pressure is essentially equal to the applied pressure over the contact interval length.

However as the helix angle is increased above zero, the relationship between contact stress and pressure is somewhat more complex. Neglecting the 'spring' forces arising in the cage strips as the element is expanded, this relationship may be understood in terms of membrane action which requires that the axial pressure end load be reacted by the helix strips at the helix angle, both at the expanded diameter, resulting in development of an equivalent hoop stress. Therefore as the helix angle is increased above zero a portion of pressure will be reacted by this equivalent hoop stress so that contact stress will decrease. This hoop stress component is also manifest as a torsion at each end which must be reacted. If the angle is increased sufficiently, a point is reached where the pressure induced axial and hoop stresses are balanced so that none of the pressure is reacted through contact stress and the packer will not tend to expand. For helical cage angles equal to or greater than this angle (dependent on end area and helix angle at the expanded diameter) contact stress and indeed expansion cannot be achieved by the application of differential internal pressure alone but requires axial load either with or without internal pressure.

The helical cage enables development of contact stress through axial compressive load because, unlike existing strip reinforced inflatable packers where the 'helix' angle is essentially zero, curvature of the helix tends to induce an 'arching action' when in contact with a confining surface. This arching action not only enables the development of compression induced contact stress, but also enables reaction of significant axial compressive loads.

Where means are provided to 'lock' in the set force, this arching action of the helical cage enables the packer element to be mechanically retained in its set position whether set by pressure or axial displacement. This ability to be mechanically retained does not preclude pressure retention methods where flow control devices are provided to trap and perhaps also release the setting pressure.

The magnitude of compressive load which the helical cage can react depends on the full spectrum of solid mechanics design parameters but in general increases with helix angle and may be limited by buckling. The utility of the method is not restricted to the elastic limit of the cage material but may exploit its plastic capacity.

Combined Geometric and Structural Design Properties of Helical Cage

From the foregoing, it should be apparent to one skilled in the art, that the design variables of helix angle and number of strips, enables a helical cage to be configured as the primary reinforcing component of a composite expandable packer element to meet a large spectrum of design requirements for packer devices. It should also be apparent that the helix angle need not be constant nor does the diameter. However helix angles near 45° are particularly well suited to petroleum drilling and completion applications as anticipated for the preferred embodiment.

The cages may also be configured with means to provide linking between strips in combination with or without overlapping of the strips as a means to prevent excess gap openings, provided the linking does not unduly inhibit the relative sliding movement between strips occurring during expansion or retraction.

DESCRIPTION OF THE PREFERRED EMBODIMENT

Figure 1:
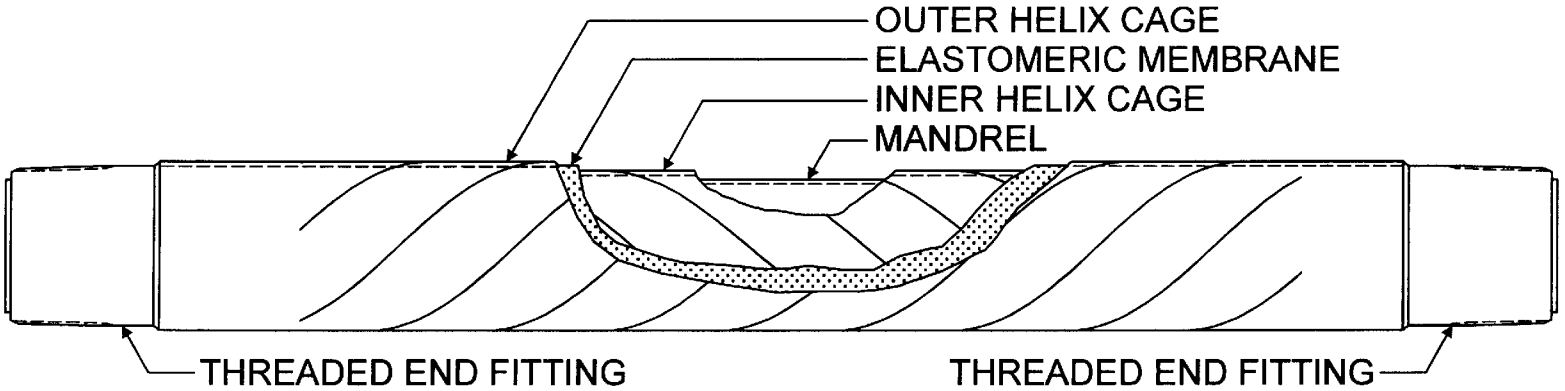
FIG. 1 is a cut away view of a device utilizing the helical cage method to create a packer suitable for oil field down hole service.
Figure 2:
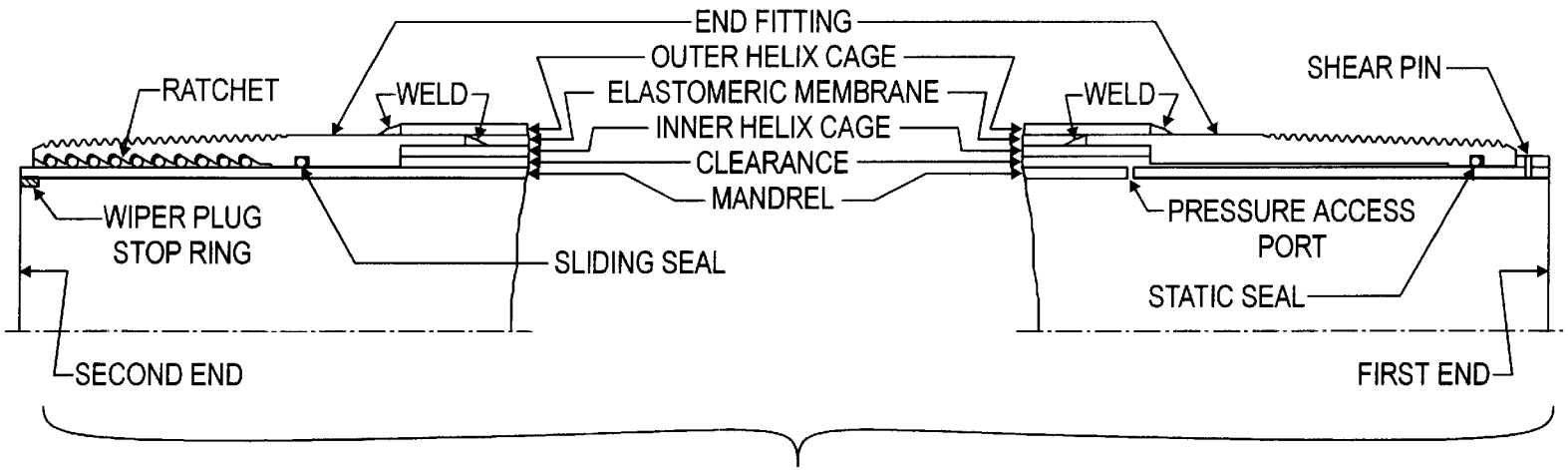
FIG. 2 is an assembly drawing showing a cross sectional view of this tool in its unexpanded or unset configuration.

While the properties of single steep pitch helical cages have been summarized to teach how their design variables may be adjusted to meet differing economic and functional requirements of packers, it should be apparent to one skilled in the art that this method can be combined with itself and other methods to create a packer tool. One such took, suitable for inclusion in a well bore casing completion string, is shown in FIG. 1. In this tool, two helical cages, enclosing an elastomeric membrane, are combined to form a composite packer element system. As shown in FIG. 2, this packer element is further combined with a ratcheting inner mandrel to provide additional functionality.

Dual Steep Pitch Helix Packer Element Assembly

The composite element system is comprised of a flexible cylindrical sealing membrane (elastomeric hose), inner and outer helical cages and end fittings. The cages are both formed of suitable rigid materials with similar helix angles but of opposite direction. When coaxially assembled, the flexible cylindrical sealing membrane is confined between the inner and outer helix cages where the ends of the cages and membrane are joined together with end fittings to form rigid and sealing connections at the first and second ends of the assembly as shown in FIG. 2.

Each cage is formed from a pipe, slit along say six (6) evenly spaced helical lines starting and ending within the tube length and interrupted periodically to form six individual coils fastened to the uncut portion of the tube at each end and 'stitched' to each other at intervals along the slit. The tube lengths and uncut intervals at each end of the inner and outer cages are such that all or a portion of the uncut intervals overlap at both ends when coaxially assembled. The 'stitches' are provided to facilitate assemlby and resist installation loads but are sufficiently weak to be sheared when the setting load or pressure is applied. For each tube, helix angles of 35° are specified. The diameter to thickness ratio of the cylindrical cages is approximately 40 and the cage lengths are typically 10 or more times the diameter. But as previously disclosed, the helix angle and other geometry variables may be adjusted to suit various application requirements.

When subjected to axial compressive load or pressure sufficient to shear the stitches, the cages tend to expand cooperatively carrying the membrane with them. Torsion required to prevent rotation of one cage is supplied by the other cage because the helixes are of opposite wind or screw direction and similar pitch. The combined element system is thus largely torque or rotation neutral.

The flexible cylindrical membrane is specified as a hose, constructed using a suitable elastomeric material (e.g., nitrile) and reinforced with outer and inner uni-direction rubber calendering fibre layers. To ensure deformation compatibility with the cage, the elastomeric reinforcement should not tend to prevent expansion, therefore the fibre lay angles are approximately equal to magnitude to the adjacent helix cage angle but of opposite sign. In the preferred embodiment, this hose is constructed in a manner typical of high pressure applications, such as concrete placement hoses, where an inner layer of calendered cable wire is placed on a forming mandrel at the specified lay angle, followed by a middle layer of elastomer (rubber) and an outer layer of calendered cable wire at the same lay angle but opposite wind direction. The membrane (hose) wall thickness is sufficient to largely fill the annular space between the cages promoting concentric placement of the helical coils. The membrane length is sufficient for its ends to overlap at least a portion of the overlapping uncut intervals of both the assembled inner and outer cages, in which mutually overlapping interval, a seal is formed.

For the immediately anticipated application, where sealing modest pressure differentials against smooth open hole of relatively soft rock is required, the packer element is expected to provide adequate performance without an external elastomeric layer as shown in FIG. 1. However in other applications, contact sealing may be further promoted by providing an outer elastomeric layer, suitably bonded or attached to the outer helix. In this case bonding between the outer layer and the membrane may be promoted by providing holes at locations where the midsection lines of the inner and outer helix cage strips intersect.

Mandrel and Friction Ratchet

Figure 3:
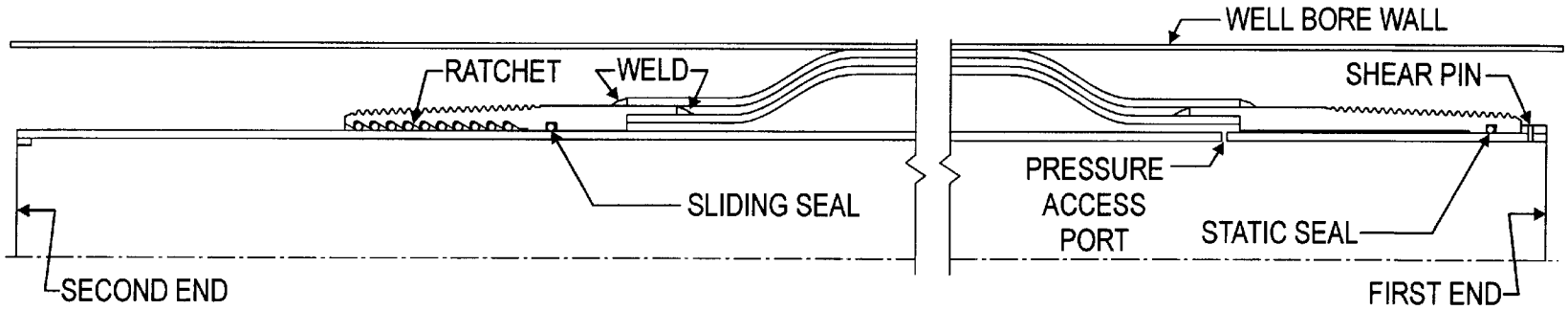
FIG. 3 shows a cross sectional view of the tool assembly as it would appear set in a well bore.

The addition of an inner mandrel and ratchet to the packer element, as shown in FIG. 2, provides a means to hold or lock the packer in its set position after the setting load or pressure is removed. The mandrel is configured to have its first end fastened to, or retained at, the first end of the element assembly and its second end passed through the friction ratchet placed on the inside of the second end of the element assembly. As would a conventional toothed ratchet, the friction ratchet is arranged to permit relatively free sliding of the mandrel during setting but grips the mandrel preventing relative movement between the mandrel and element second end in the unset direction. FIG. 3 shows the packer in its set configuration where the mandrel has been stroked through the ratchet which now prevents axial rebound.

Figure 4:
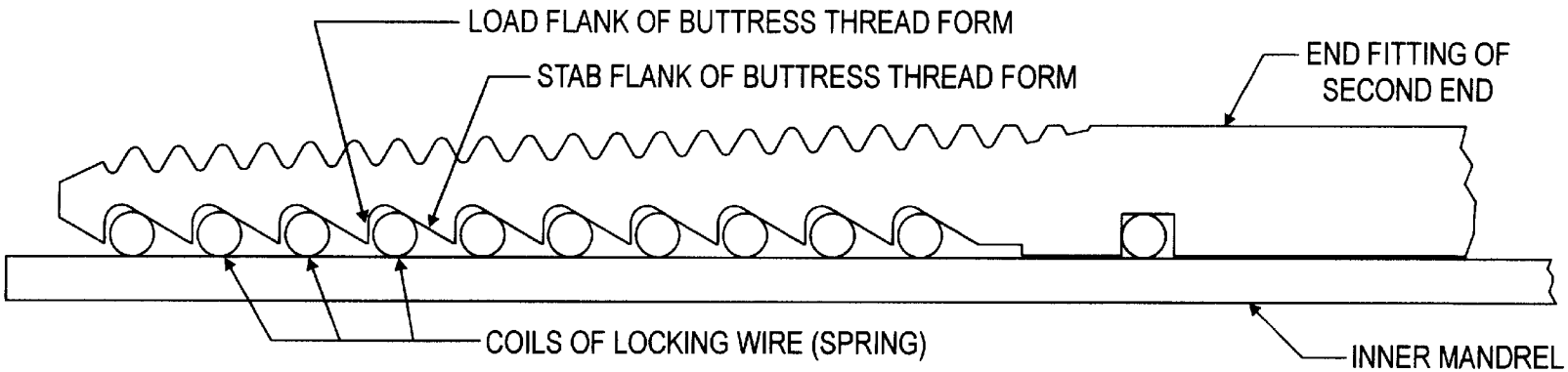
FIG. 4 shows a cross sectional view of the friction ratchet employed to control relative axial movement between the end fitting at the second end and the mandrel.

As shown in FIG. 4, the friction ratchet is comprised of a coiled wire—in essence a coil spring—placed between the outside surface of the mandrel and the helically formed or buttress threaded inner surface of the end fitting. As shown, the flanks of the thread form, commonly referred to as the load and stab flanks, are configured to have differing angles. The load flank is nearly 90° to the cylinder axis and the stab flank is much less. The unloaded coil inside diameter is somewhat less than the mandrel outside diameter so that when mounted on the mandrel the coil exerts a radial force and 'grips' the mandrel. It thus tends to move with the mandrel if the mandrel is displaced axially relative to the end fitting. However such movement will cause the wire to contact one of the two flanks depending on direction. Under the application of loads tending to expand the packer the wire contacts the load flank and will slide on the mandrel. However for displacement in the reverse direction, friction forces will tend to cause the wire to roll under the stab flank and become entrapped between the mandrel and end fitting, thus preventing further relative movement between them. As should be apparent to one skilled in the art, the design must consider the possible range of friction coefficients to ensure the stab flank angle is sufficiently shallow to trigger entrapment rather than sliding. And for this angle, the other mechanical design parameters such as thread length, diameter, wall thickness, material properties, etc. must provide sufficient strength to accommodate the expected axial loads.

While the friction ratchet thus provided has the advantage that it can grip on the relatively smooth outside surface of the mandrel allowing a shorter tool length, a conventional toothed ratchet may be employed as an alternative. However if such a ratchet is employed, 'teeth' must be placed on the second end of the mandrel over an interval long enough to accommodate the anticipated stroke. Since this surface is not compatible with the sliding seal the length of the second end fitting must be increased to accommodate the toothed portion of the mandrel between the sliding seal and ratchet.

For applications where retrieval is required, the fastening system at the first end of the mandrel is configured to shear or release at a predetermined magnitude of applied axial tensile load. Once released, the mandrel no longer prevents stroking in the unset direction and the packer will tend to retract.

To facilitate pressure inflation, the mandrel is provided with a pressure access port and seals are provided between the mandrel and end fittings as shown in FIG. 2. This arrangement allows fluid entering the port to inflate the packer. Although not shown, the pressure port may be further equipped with a check valve and other flow control devices, well known in the art, to both retain inflation pressure and provide for subsequent release.

Operation of the Packer Tool

To illustrate the operation of the packer tool, consider its use in applications requiring water shut off or zonal isolation in horizontal wells as discussed in the "Background to the Invention". In this case it is required that two packers joined by a tubing string be run in the wellbore on a carrier string, the packers set at a location so as to straddle the water inflow zone, and the carrier string then released from the top packer and pulled out of the hole leaving the inflated packers and connecting tubing to act as a water 'inflow patch'. The reverse operation is also required where a carrier string is run in to latch the top packer, unset the packers and remove the entire 'inflow patch' comprising top and bottom packers and connecting tubing.

In this application, the present invention may be used for the top and bottom packers where the first end of the bottom packer is made up to the bottom end of the casing string, the second end of the top packer is made up to the top of the tubing string and the first end of the top packer made up to a fixture containing the carrier string latching mechanisms such as a J-latch commonly employed for such purposes. The second end of the mandrel is further fitted with an inner ring capable of catching a retrievable wiper plug. During running, the packers must react axial load arising from the weight of any components carried below the packers plus drag induced by string movement plus end load from bridges or obstacles. Where the net axial installation load is tensile, the packer element and mandrel together react the load because the ratchet tends to prevent extension; but where the installation load is compressive, only the packer element is loaded since the ratchet slides relatively freely in compression. As mentioned earlier, the 'stitches' between helix strips, formed at locations where the helical cuts are interrupted, provide the necessary axial strength preventing the packer from premature setting. This axial load capacity also provides flexural stiffness to resist buckling tendencies under installation loads.

Once the packers have been run in to the required wellbore location, the bottom packer is set by pumping down a wireline retrievable plug and pressuring against it. Fluid entering the pressure access port provided in the mandrel causes the packer to inflate. Setting may be further augmented by the application of compressive load which will tend to further set the packer and improve the degree of conformable contact between the packer outer cage and the wellbore. Application of further axial compressive load and or pressure will then cause the upper packer to set where the difference in set force between the upper and lower packer is controlled by the number and size of 'stitches' and the pressure end load. Once both packers are thus set, pressure is removed and the carrier string manipulated to unlatch it from the 'inflow patch' and remove the carrier string from the hole.

Retrieval is accomplished by reentering the hole with the carrier string and latching the top packer. Because the set packers act as anchors, application of tensile load will first cause the mandrel shear connection of the upper packer to release allowing the packer to retract followed by the lower packer. Once retracted, both packers with the conjoining tubing (the inflow patch) may be pulled from the well bore.

Alternate Embodiments

As an alternative embodiment, we believe a packer similar to that shown in FIGS. 1 to 3, but where either the inner or outer helical cage is omitted, may be used to provide sealing in applications where only a unidirectional through wall pressure differential is anticipated, i.e., if the outer cage is omitted the membrane will only be supported by the remaining inner cage against an external pressure differential. Similarly if the inner cage is omitted the membrane will only be supported by the remaining outer cage against an external pressure differential. In this form, the torsional load of the single cage under axial load will no longer be compensated by the second cage therefore other means must be provided to react this force. This may be provided through the connecting tubulars external to the packer system or may be reacted through the mandrel by providing a sliding key-way or splined connection between the end fitting of the second end and the mandrel as will be evident to one skilled in the art.

In another aspect of the preferred embodiment, the mandrel may be adjusted to carry the axial load by providing it with connections suitable for joining to the rest of the tubular string. This architecture is that typically used for inflatable packers, where one or both end fittings slide and seal on the mandrel, but does not provide for the ability to directly activate packer expansion through the application of axial compressive load. In this alternate configuration packer expansion may be initiated by internal pressure or may be 'rotation set' as is commonly employed for solid element packers. Mechanical latching may still be provided but means to retract the element then become less direct and more complex.

In another aspect of the preferred embodiment, we believe the packer can be configured to provide annular sealing by inward displacement in application where sealing or loading against an inside rod or tube is required. For this application the packer as shown in FIGS. 1 and 2 would be essentially inverted so that the element would appear on the inside and radial movement inwards caused by tensile load.

In another aspect of the preferred embodiment the seals between the mandrel and end fittings may be omitted where pressure setting is not required.

In another aspect of the preferred embodiment, where it is not required to mechanically retain the packer, the ratchet may be omitted.

In another aspect of the preferred embodiment, where it is not required to mechanically retain the packer and the element provides sufficient flexural rigidity, the ratchet and mandrel may be omitted.

In another aspect of the preferred embodiment, the use of stitches as described in the preferred embodiment should be understood as only one means to control the relationship between setting forces and radial displacement. Other methods such as hoop straps or links between strips may be provided such that they fail at a predetermined setting load or pressure before allowing significant radial displacement. In fact, the elastic properties of the membrane layers and the cages alone may provide sufficient control of radial expansion under the range of design loads.

In another aspect of the preferred embodiment, we believe the slits between strips may be arranged to have a continuous or intermittent saw tooth pattern so as to provide a ratcheting action as shear displacement occurs during setting or unsetting actions. This ratcheting action will be seen to arise as the 'ratchet teeth' snap past each other where the load required to cause such displacement depends on the saw tooth angles and inter-strip contact forces. This ratcheting action may be employed with or without stitches or their equivalent to control the relationship between setting forces and radial displacement. Similarly this ratcheting action may be used to retain the packers in its set configuration to either augment or replace the function of the mandrel mounted friction ratchet described in the preferred embodiment.

We further believe the ability to expand the packer and develop radial contact forces on the surface of the borehole the packer can be exploited to advantage in applications requiring such forces with or without the ability to seal. In these applications the helical cage design parameters such as helix angle and wall thickness can be adjusted to provide radial forces capable of expanding say deformed or collapsed well casing. For these applications the number of helical cages may also be increased so that several cage layers are nested to provide greater load capacity. The function of the membrane between the layers may either be unnecessary in which case it may be omitted or it may become more one of lubrication or friction reduction, rather than sealing, in which case the membrane may be retained but its material selection adjusted to provide less sliding resistance.

The embodiments of the invention in which an exclusive property or privilege is claimed are defined as follows:

1. A radially expandable seal element for bridging an annular clearance separating the seal element from a confining wall, comprising:

a cylindrical cage having a side wall formed by a plurality of structural, coaxial, helically parallel coils having ends and side edges; and elastomeric means for sealing the side edges of the coils to provide pressure containment across the cage side wall.

2. The seal element as set forth in claim 1 comprising:

end sleeves joining the coil ends of the cage.

3. A radially expandable seal element for bridging an annular clearance separating the seal element from a confining wall, comprising:

inner and outer cylindrical cages, each cage having a side wall formed by a plurality of structural, coaxial, helically parallel coils having ends and side edges, and elastomeric means between the cages for sealing the side edges of the coils to provide pressure containment across the cage side wall.

4. The seal element as set forth in claim 3 wherein:

the coils of one cage have a helix screw direction opposed to the helix screw direction of the other coil.

* * * * *